US006293551B1

(12) United States Patent
Webb

(10) Patent No.: US 6,293,551 B1
(45) Date of Patent: Sep. 25, 2001

(54) BLACKJACK CARD GAME INCORPORATING TWO-CARD 21 WAGERS

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

(21) Appl. No.: 09/419,871

(22) Filed: Oct. 19, 1999

(51) Int. Cl.[7] ..... A63F 1/00
(52) U.S. Cl. ..... 273/292; 273/274; 463/12
(58) Field of Search ..... 273/292, 274; 463/12, 13

(56) References Cited

U.S. PATENT DOCUMENTS 5,320,356 * 6/1994 Cauda .
5,660,392 * 8/1997 Hansen .
5,743,532 4/1998 Lafferty .
5,791,989 * 8/1998 Slinkman .
5,829,750 * 11/1998 Booker .
5,836,586 * 11/1998 Marks .

* cited by examiner

*Primary Examiner*—Benjamin H. Layno
*Assistant Examiner*—Vishu K. Mendiratta
(74) *Attorney, Agent, or Firm*—Nixon & Vanderhye P.C.

(57) ABSTRACT

In a casino Blackjack game, the concept of the insurance wager against a dealer Blackjack (two-card total of 21) is expanded to provide a player wagering option when a dealer first card is either an Ace or a ten-value card. An additional wagering option is provided when a player first card is either an Ace or a ten-value card that the player two-card total will be 21. Payouts for the respective wagers are varied according to whether the dealer or player first card is the Ace or the ten-value card and whether the two-card twenty-one is comprised of cards of a predefined relation such as same suit or color or cards including a 10-value card of a particular rank. The additional wagering option adds an exciting element to the conventional Blackjack game, resulting in a more enjoyable game and increased play.

24 Claims, 2 Drawing Sheets

BLACKJACK CARD GAME INCORPORATING TWO-CARD 21 WAGERS

BACKGROUND OF THE INVENTION

The present invention relates to card games and, more particularly, to a Blackjack card game incorporating a two-card 21 proposition wager.

With the expansion of gaming and the increase in competition, casinos are striving to offer a wider variety of games. Growth in slot machine popularity and the increase in variety of specialty games has resulted in the overall reduction in conventional Blackjack ("21") tables.

Many casinos, however, are reluctant to reduce the number of Blackjack tables because of the inherent game attractiveness to both players and casinos. The game is based on simple concepts and procedures that are readily understood by both casual and regular players. Moreover, the game requires relatively low overhead to facilitate and monitor. In addition, floor space is limited in a casino, and casino operators are reluctant to replace an income-generating Blackjack table with a new game variety.

Although Blackjack is currently the most popular casino game, the majority of Blackjack games feature only one bet most of the time. Virtually every Blackjack game features an optional proposition wager known as insurance. The insurance wager may be placed after the first two cards to each player and dealer have been dealt and in the instance that the dealer face-up card is an Ace. The insurance wager is a bet that the dealer will have a two-card hand total of 21, known as "Blackjack." The odds paid on the insurance wager throughout the industry are 2 to 1. The true odds against a Blackjack hand with an Ace showing, however, are 4 in 13 or 9 to 4 (four ranks of cards of Kings, Queens, Jacks and Tens, known as 10-value cards, versus nine ranks of non 10-value cards). The odds provide an excessive house advantage, and most gaming authors advise against making this wager, except where player known deck composition using skill techniques justifies doing so.

Moreover, as the wager is only available when an Ace is showing (which occurs on average once every 13 hands), many players, particularly novices, are not familiar with the nature of the wager. Also, as the wager is placed during the actual round of the Blackjack game, it must be operated by dealer announcement of the wager option. As dealers know, most players do not make the wager and the payoff is poor, and thus, dealer announcement is usually in a disinterested manner.

An additional problem with the current operation of Blackjack is that the dealer down card, also known as the hole card, may be vulnerable to being spotted by a player accomplice where a dealer is not using best procedure. Therefore, a player may have an option to make a wager knowing the exact outcome. A change in methodology of play to avert this occurrence would be beneficial in protecting the security of the game.

SUMMARY OF THE INVENTION

It would thus be desirable to incorporate an additional proposition wager in the conventional Blackjack game that occurs with higher frequency, has a fairer house advantage, a variety of payoff odds, and strong operational integrity. Such factors would ensure improved entertainment value, a higher degree of player participation, a higher player wager level, less security concerns, a more positive dealer attitude and higher casino revenue.

In accordance with the present invention, a methodology is described wherein players can wager that a two-card total of 21 will occur for the dealer and/or player when the dealer or player, respectively, first card is either an Ace or a 10-value card. The multitude of options for wagering and payouts makes the game considerably more exciting for the players by increasing the occurrence of such wagering opportunities. Because the proposition wager according to the invention is incorporated into the conventional Blackjack card game, existing table space can be utilized, and the general play of the game would remain unchanged.

A dealer Blackjack, or two-card total of 21, can be achieved two ways. First, the dealer may be dealt a face-up Ace and then subsequently dealt a 10-value hole card. When the dealer is dealt a face-up Ace, most conventional Blackjack games provide the proposition insurance wager. Alternatively, however, the Blackjack hand can be created when the dealer has a face-up 10-value card and an Ace hole card. Because there are considerably more 10-value cards than Aces in a conventional deck of cards, there would necessarily be an increased number of opportunities for two-card 21 proposition wagers if offered when the dealer is dealt a face-up 10-value card. Still additional opportunities arise when a player is dealt a first card Ace or a first card 10-value card. As these events are separately mutually exclusive for both the dealer and player, respectively, the same wager areas on the layout could be utilized.

By combining the dealer card wager options together, the frequency of wager opportunity is increased from 1 in 13 (being an Ace face-up card) to 5 in 13 (including the four 10-value cards). This is a dramatic five-fold increase from the current scenario. Additionally, higher odds can be paid when the dealer face-up card is a 10-value card, with a rarer Blackjack frequency than in the traditional aspect where the face-up card is an Ace. The aspects can also be combined into one wager such that odds can be quoted for the whole wager, giving a perception of better overall returns.

If the wager is offered after dealing one card only to each player and dealer, then there is no possibility of players having prior knowledge of the dealer hole card. Additionally, each player with a 10-value card or an Ace has the same chance of making Blackjack as the dealer. This methodology allows an opportunity for the player to wager that the player hand will be a Blackjack. As a consequence, this doubles the new wager frequency, and provides a total ten-fold increase in wager opportunity.

Still further, different combinations of Blackjack could be given different payoff odds to provide a fairer wager and an enhanced perception of this fairness. For example, a higher payoff may be provided where the Blackjack is suited (i.e., the Ace and the 10-value card in the two-card hand total of 21 being of the same suit). Rather than one traditional insurance scenario, there are thus a total of eight scenarios, with four different scenarios for each of the two wagers.

According to the present invention, there is provided a method of playing a casino Blackjack card game using at least one deck of cards. The method includes (a) dealing a player first card to a player and a dealer first card to a dealer, (b) if the player first card is an Ace or a 10-value card, providing an option for the player to wager that a player two-card total will be 21, and (c) if the dealer first card is an Ace or a 10-value card, providing an option for the player to wager that a dealer two-card total will be 21. The method may further include (d) dealing a player second card to the player and a dealer second card to the dealer, and (e) if the player wagered according to step (b) or step (c), resolving the wagers according to the player and dealer two-card totals, respectively. After step (e), the method includes continuing with a Blackjack game.

Step (e) is preferably practiced by (e1) paying a first payout if the player first card or the dealer first card is an Ace and the respective player second card or the dealer second card is a 10-value card, and (e2) paying a second payout, higher than the first payout, if the player first card or the dealer first card is a 10-value card and the respective player second card or the dealer second card is an Ace. Step (e) may further be practiced by (e3) paying a third payout, higher than the first payout if the player first card or the dealer first card is an Ace and the respective player second card or the dealer second card is a 10-value card having a predefined relationship with the player first card or the dealer first card, and (e4) paying a fourth payout, higher than the second payout, if the player first card or the dealer first card is a 10-value card and the respective player second card or the dealer second card is an Ace having a predefined relationship with the player first card or the dealer first card. The predefined relationship may be a same suit or color. In preferred forms, the first payout is 2 to 1, the second payout is 10 to 1, the third payout is 5 to 2, and the fourth payout is 15 to 1. In the case of a first card Ace, the payout may also be modified in accordance with a particular 10-value rank (10, Jack, Queen, King).

In accordance with another aspect of the invention, there is provided a method of playing a casino Blackjack card game using at least one deck of cards. The method includes (a) dealing a player first card to a player, and (b) if the player first card is an Ace or a 10-value card, providing an option for the player to wager that a player two-card total will be 21. In a related context, according to another aspect of the invention, the method includes (a) dealing a dealer first card to a dealer, and (b) if the dealer first card is a 10-value card, providing an option for the player to wager that a dealer two-card total will be 21.

According to still another aspect of the invention, there is provided an apparatus configured for playing a casino Blackjack card game using at least one deck of cards including a display, a player interface for receiving player input, and a processor configured to effect game play. The processor is programmed to enable the method according to the invention.

In accordance with still another aspect of the invention, there is provided a casino Blackjack game, including at least one deck of cards, and a table layout having a plurality of betting areas including (1) a competition wager area for a first wager that a player will win the game, (2) a proposition wager area for a second wager that a player two-hand total will be 21 when a player first card is an Ace or 10-value card, and (3) a proposition wager area for a third wager that a dealer two-hand total will be 21 when a dealer first card is an Ace or a 10-value card. The table layout may further include a rules area specifying game rules and payouts.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
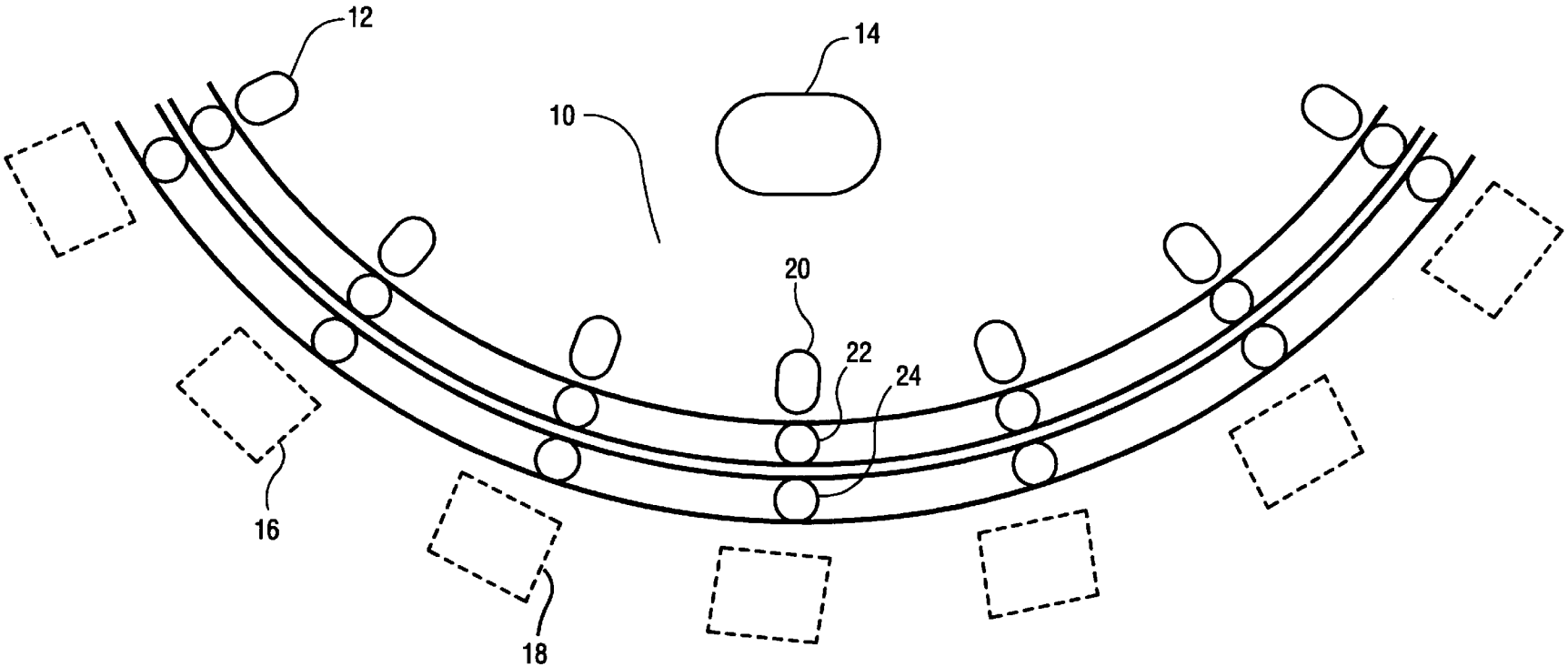
FIG. 1 is a plan view of the table layout according to the present invention.

Referring to FIG. 1, the table layout includes a playing area 10 with betting areas 12 for a plurality of players, for example, seven players. The layout includes a dealer area 14, payoff scales 16 and game rules 18. Each player area 12 contains three specific bet areas including a competition area 20 for the initial competition wager against the dealer, a dealer hand Blackjack area 22 for the dealer hand Blackjack proposition wager, and a player hand Blackjack area 24 for the player hand Blackjack proposition wager.

The game is preferably the same as conventional Blackjack, using one or more regular 52-card decks. To play the game, the player places a wager at area 20 to play against the dealer, and the dealer deals a card to each player and self with the dealer card dealt face-up. If the player first card is an Ace or a 10-value card, that player is given an option to wager in area 24 that a player two-card total will be 21. That is, if the player first card is an Ace, the player is wagering that the player second card will be a 10-value card. On the other hand, if the player first card is a 10-value card, the player is wagering that the player second card will be an Ace.

In a similar context, if the dealer first card is an Ace or a 10-value card, all players are provided with the option to wager at area 22 that the dealer two-card total will be 21. A second card is then dealt to each player and dealer with the dealer card being dealt face down.

If the dealer does not have Blackjack, all bets at area 22 lose, whereas if the dealer has Blackjack, all bets at area 22 win. If the player first card was an Ace or a 10-value card and the player wagered at area 24, if the player does not have Blackjack, the player wager at area 24 loses, whereas if the player has Blackjack, the player wager at area 24 win. Payoff odds on winning wagers are paid dependent upon numerous factors including desired casino advantage, the number of decks played, the degree of deck penetration allowed by the operator, minimum and maximum bets allowed, etc. As mentioned previously, because there is a greater chance of obtaining a two-card total of 21 (i.e., Blackjack) when the dealer or player first card is an Ace, the payout for this wager is naturally lower. Additionally, further structuring of payouts can include higher payouts for hands of suited Blackjack, i.e., consisting of an Ace and a 10-value card of the same suit (conventional suits including Hearts, Diamonds, Spades and Clubs) or colored Blackjack, i.e., consisting of an Ace and a 10-value card of the same color (red or black), or for a specific rank of a 10-value card (10, Jack, Queen, or King) or the like.

A preferred exemplary payout schedule for winning wagers at areas 22 or 24 is shown in Table 1.

| First Card | Blackjack | Payoff |
|---|---|---|
| Ace | Unsuited | 2 to 1 |
| Ace | Suited | 5 to 2 |
| 10-value | Unsuited | 10 to 1 |
| 10-value | Suited | 15 to 1 |

Of course, those of ordinary skill in the art will contemplate other payout scenarios, and the invention is not meant to be limited to the Table 1 schedule.

After wagers at area 24 are resolved, wagers at area 22 are resolved, and the game then proceeds as in regular Blackjack.

As would be apparent to those skilled in the relevant art, the invention can be embodied in a wide variety and forms of media such as, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disk, etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
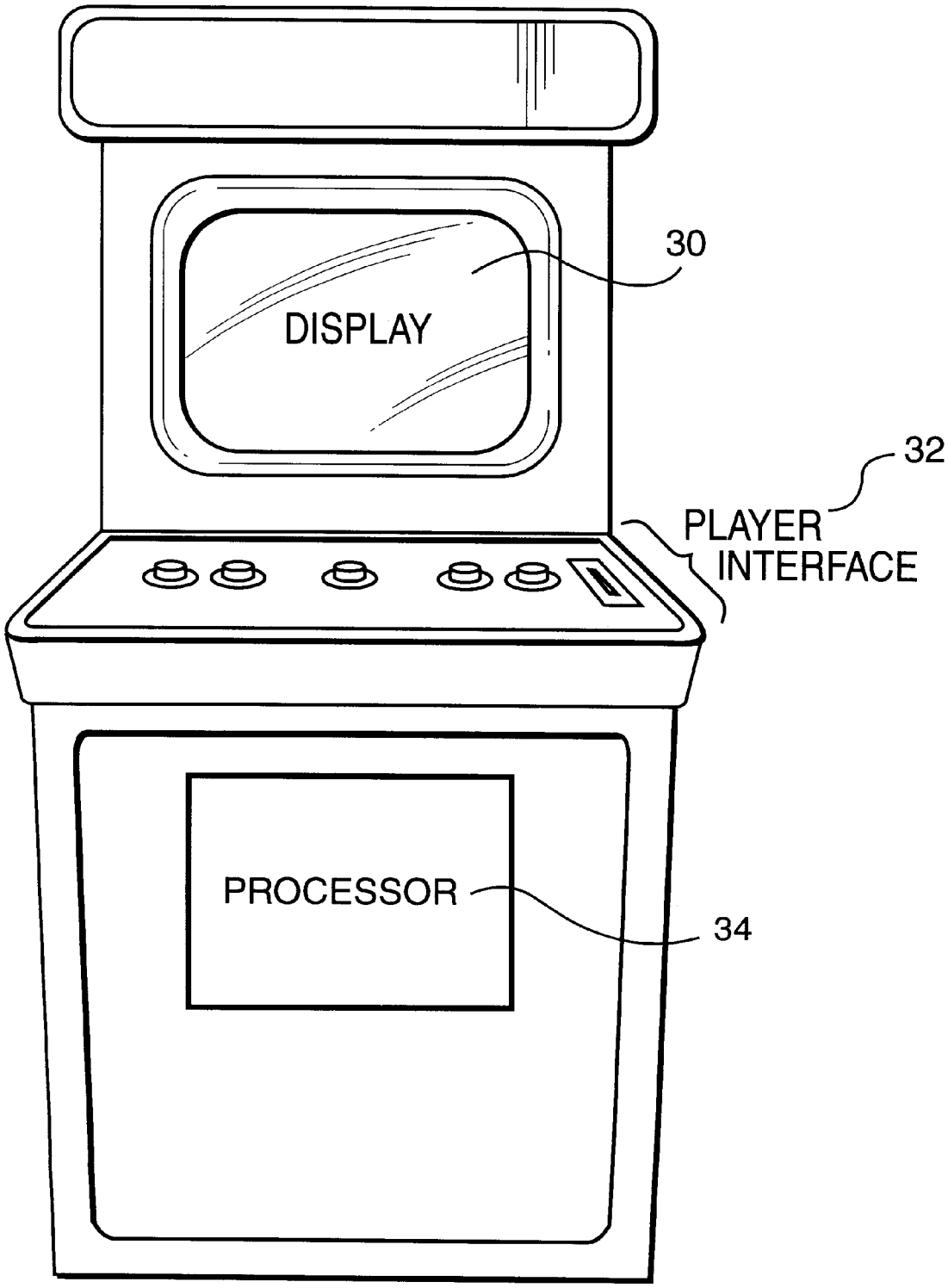
FIG. 2 is a block diagram illustrating the structure effecting game play according to the apparatus of the present invention.

In this context, referring to FIG. 2, a block diagram is illustrated showing the components of an apparatus configured for playing the game according to the invention. The apparatus includes a display 30, a player interface 32, and circuitry 34 for effecting game play and including structure for dealing hands and offering proposition wagers according to a dealer first card and a player first card. A processing circuit 34 effects game play according to the rules of the game and resolves wagers based on player and dealer second cards as necessary and according to the game outcome.

With the game according to the present invention, operationally sound and attractive proposition wagers have been created by the innovation of a new insurance wager, the innovation of combining the new insurance wager with the traditional insurance wager, the innovation of allocating different orders of merit to different hand structures, and the innovation of a new methodology of also allowing the same wager option on each player hand. The resulting Blackjack game is a familiar game that adds excitement with increased player winning opportunities, thereby attracting more play and generating more income for the casino operator.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a casino Blackjack card game using at least one deck of cards, the method comprising:

(a) dealing a player first card to a player and a dealer first card to a dealer;

(b) if the player first card is an Ace or a ten-value card, providing an option for the player to wager that a player two-card total will be twenty-one; and (c) if the dealer first card is an Ace or a ten-value card, providing an option for the player to wager that a dealer two-card total will be twenty-one.

2. A method according to claim 1, further comprising:

(d) dealing a player second card to the player and a dealer second card to the dealer; and (e) if the player wagered according to step (b) or step (c), resolving the wagers according to the player and dealer two-card totals, respectively.

3. A method according to claim 2, further comprising, after step (e), continuing with a Blackjack game.

4. A method according to claim 2, wherein step (e) is practiced by (e1) paying a first payout if the player first card or the dealer first card is an Ace and the respective player second card or the dealer second card is a ten-value card, and (e2) paying a second payout, higher than the first payout, if the player first card or the dealer first card is a ten-value card and the respective player second card or the dealer second card is an Ace.

5. A method according to claim 4, wherein step (e) is further practiced by (e3) paying a third payout, higher than the first payout, if the player first card or the dealer first card is an Ace and the respective player second card or the dealer second card is a ten-value card having a predefined relationship with the player first card or the dealer first card, and (e4) paying a fourth payout, higher than the second payout, if the player first card or the dealer first card is a ten-value card and the respective player second card or the dealer second card is an Ace having a predefined relationship with the player first card or the dealer first card.

6. A method according to claim 5, wherein the predefined relationship is a same suit.

7. A method according to claim 6, wherein the first payout is 2 to 1, the second payout is 10 to 1, the third payout is 5 to 2, and the fourth payout is 15 to 1.

8. A method according to claim 5, wherein the predefined relationship is a same color.

9. A method according to claim 4, wherein step (e) is further practiced by (e3) paying a third payout, higher than the first payout, if the player first card or the dealer first card is an Ace and the respective player second card or the dealer second card is a ten-value card of a particular rank.

10. A method of playing a casino Blackjack card game, wherein playing cards are dealt to at least one player and a dealer, and wherein the at least one player plays against the dealer such that the player wins the game if (1) the player card total is closer to twenty-one than the dealer card total, without exceeding twenty-one, or (2) the dealer card total exceeds twenty-one while the player card total does not exceed twenty-one, or (3) a player two-card total is twenty-one while a dealer two-card total is not twenty-one, wherein the player has an option to draw cards and the dealer draws cards according to Blackjack rules, the method comprising:

(a) dealing a player first card to the player and a dealer first card to the dealer;

(b) if the player first card is an Ace or a ten-value card, providing an option for the player to wager that a player two-card total will be twenty-one; and (c) if the dealer first card is an Ace or a ten-value card, providing an option for the player to wager that a dealer two-card total will be twenty-one.

11. A method of playing a casino Blackjack card game using at least one deck of cards, the method comprising:

(a) dealing a player first card to a player; and (b) if the player first card is an Ace or a ten-value card, providing an option for the player to wager that a player two-card total will be twenty-one.

12. A method according to claim 11, further comprising:

(d) dealing a player second card to the player; and (e) if the player wagered according to step (b), resolving the wager according to the player two-card total.

13. A method according to claim 12, further comprising, after step (e), continuing with a Blackjack game.

14. A method according to claim 12, wherein step (e) is practiced by (e1) paying a first payout if the player first card is an Ace and the player second card is a ten-value card, and (e2) paying a second payout, higher than the first payout, if the player first card is a ten-value card and the player second card is an Ace.

15. A method according to claim 14, wherein step (e) is further practiced by (e3) paying a third payout, higher than the first payout, if the player first card is an Ace and the player second card is a ten-value card having a predefined relationship with the player first card, and (e4) paying a fourth payout, higher than the second payout, if the player first card is a ten-value card and the player second card is an Ace having a predefined relationship with the player first card.

16. A method according to claim 15, wherein the predefined relationship is a same suit.

17. A method according to claim 16, wherein the first payout is 2 to 1, the second payout is 10 to 1, the third payout is 5 to 2, and the fourth payout is 15 to 1.

18. A method according to claim 15, wherein the predefined relationship is a same color.

19. A method according to claim 14, wherein step (e) is further practiced by (e3) paying a third payout, higher than the first payout, if the player first card is an Ace and the player second card is a 10-value card of a particular rank.

20. A method of playing a casino Blackjack card game using at least one deck of cards, the method comprising:

(a) dealing a dealer first card to a dealer; and (b) if the dealer first card is a ten-value card, providing an option for the player to wager that a dealer two-card total will be twenty-one.

21. A method according to claim 20, further comprising:

(d) dealing a dealer second card to the dealer; and (e) if the player wagered according to step (b), resolving the wager according to the dealer two-card total.

22. A method according to claim 21, further comprising, after step (e), continuing with a Blackjack game.

23. A method according to claim 21, wherein step (e) is practiced by (e1) paying a first payout if the dealer first card is a ten-value card and the dealer second card is an Ace of a different suit, and (e2) paying a second payout if the dealer first card is a ten-value card and the dealer second card is an Ace of a same suit.

24. A method according to claim 23, wherein the first payout is 10 to 1 and the second payout is 15 to 1.

* * * * *